US007156618B2

(12) United States Patent
Fish et al.

(10) Patent No.: US 7,156,618 B2
(45) Date of Patent: Jan. 2, 2007

(54) LOW COST DIFFUSER ASSEMBLY FOR GAS TURBINE ENGINE

(75) Inventors: Jason Araan Fish, Brampton (CA); Vittorio Bruno, Mississauga (CA); Kenneth Parkman, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 121 days.

(21) Appl. No.: 10/989,311

(22) Filed: Nov. 17, 2004

(65) Prior Publication Data

US 2006/0104809 A1 May 18, 2006

(51) Int. Cl.
*F04D 29/44* (2006.01)

(52) U.S. Cl. ..... 415/208.3

(58) Field of Classification Search ..... 415/208.2, 415/208.3, 209.2, 211.2, 214.1
See application file for complete search history.

(56) References Cited

U.S. PATENT DOCUMENTS 3,333,762 A * 8/1967 Vrana ..... 415/207
3,420,435 A * 1/1969 Jarosz et al. ..... 415/207
3,853,336 A 12/1974 Shank
4,028,888 A 6/1977 Pilarczyk
4,087,120 A 5/1978 Rumble
4,100,732 A 7/1978 Bryans et al.
4,382,747 A 5/1983 Okano
4,383,799 A 5/1983 Okano et al.
4,840,026 A 6/1989 Nash et al.
4,865,517 A 9/1989 Beehler
5,921,592 A 7/1999 Donnelly
6,079,199 A 6/2000 McCaldon et al.
6,092,361 A 7/2000 Romani
6,155,056 A 12/2000 Sampath et al.
6,227,801 B1 5/2001 Liu
6,450,550 B1 * 9/2002 Cornwell ..... 285/340
6,497,402 B1 12/2002 Tharp
6,589,015 B1 7/2003 Roberts et al.
6,647,730 B1 11/2003 Liu
6,880,341 B1 * 4/2005 Parkman et al. ..... 60/740

* cited by examiner

*Primary Examiner*—Edward K. Look
*Assistant Examiner*—Devin Hanan
(74) *Attorney, Agent, or Firm*—Ogilvy Renault LLP

(57) ABSTRACT

A gas turbine diffuser assembly and a method for assembling same, includes providing a loose fit between the diffuser body and the diffuser pipes. Damper members provide a snug attachment.

18 Claims, 4 Drawing Sheets

LOW COST DIFFUSER ASSEMBLY FOR GAS TURBINE ENGINE

FIELD OF THE INVENTION

The present invention relates to gas turbine engines, and more particularly to a compressor diffuser assembly for gas turbine engines.

BACKGROUND OF THE INVENTION

Conventionally, the diffuser pipes are inserted very tightly into the orifices of the diffuser ring, in order to reduce leakage of pressurized air to improve the efficiency of engine performance, and to secure them against dynamic excitation. The tight fit is difficult to achieve, thereby increasing manufacturing expenses.

Therefore, there is a need for an improved compressor diffuser assembly which is low cost and durable.

SUMMARY OF THE INVENTION

One object of the present invention is to provide a compressor diffuser assembly for gas turbine engines.

In accordance with one aspect of the present invention, there is provided a diffuser assembly for a gas turbine engine, the diffuser comprising an annular diffuser body having a plurality of orifices disposed circumferentially around an outer periphery thereof, the orifices having an inner wall, a plurality of diffuser pipes each having a first end thereof received in one of the orifices adjacent the inner wall thereof, and a flexible damper member disposed between the first end and the inner wall of at least one of the orifices.

In accordance with another aspect of the present invention, there is provided a centrifugal compressor system of a gas turbine engine, the compressor system comprising an impeller assembly driven by a shaft of the engine for generating a pressurized air flow, an annular diffuser body having a plurality of orifices disposed circumferentially spaced apart in an outer periphery thereof, the annular diffuser body being downstream of the impeller for directing the pressurized air flow, a plurality of diffuser pipes inserted at a first end thereof into the orifices of the annular diffuser body, each of the diffuser pipes having a cross section expanding towards a second end thereof, and a damper member disposed between the first end of the diffuser pipes and the orifices, thereby providing a snug attachment of the diffuser pipes to the orifices of the annular diffuser body.

In accordance with a still further aspect of the present invention, there is a method for assembling a centrifugal compressor diffuser for gas turbine engines, the method comprising providing diffuser pipes having a first end diameter, providing a diffuser body having orifices for receiving the pipes, the orifices having a diameter sufficiently larger than the first end diameter such that a loose fit is provided when the first end is inserted into the orifice, providing a damper member in at least one of the orifices and said first ends of the diffuser pipes, and inserting the diffuser pipe first ends into the orifices so that the damper member is disposed between the first ends and the orifices to thereby provide a snug attachment therebetween.

The present invention advantageously provides a compressor diffuser assembly which is convenient for manufacturing, while maintaining vibration damping within acceptable levels, thereby reducing the manufacturing costs thereof. Other features and advantages of the present invention will be better understood with reference to the preferred embodiment described hereinafter.

BRIEF DESCRIPTION OF THE DRAWINGS

Reference will now be made to the accompanying drawings in which.

DETAILED DESCRIPTION OF THE PREFERRED EMBODIMENT

Figure 1:
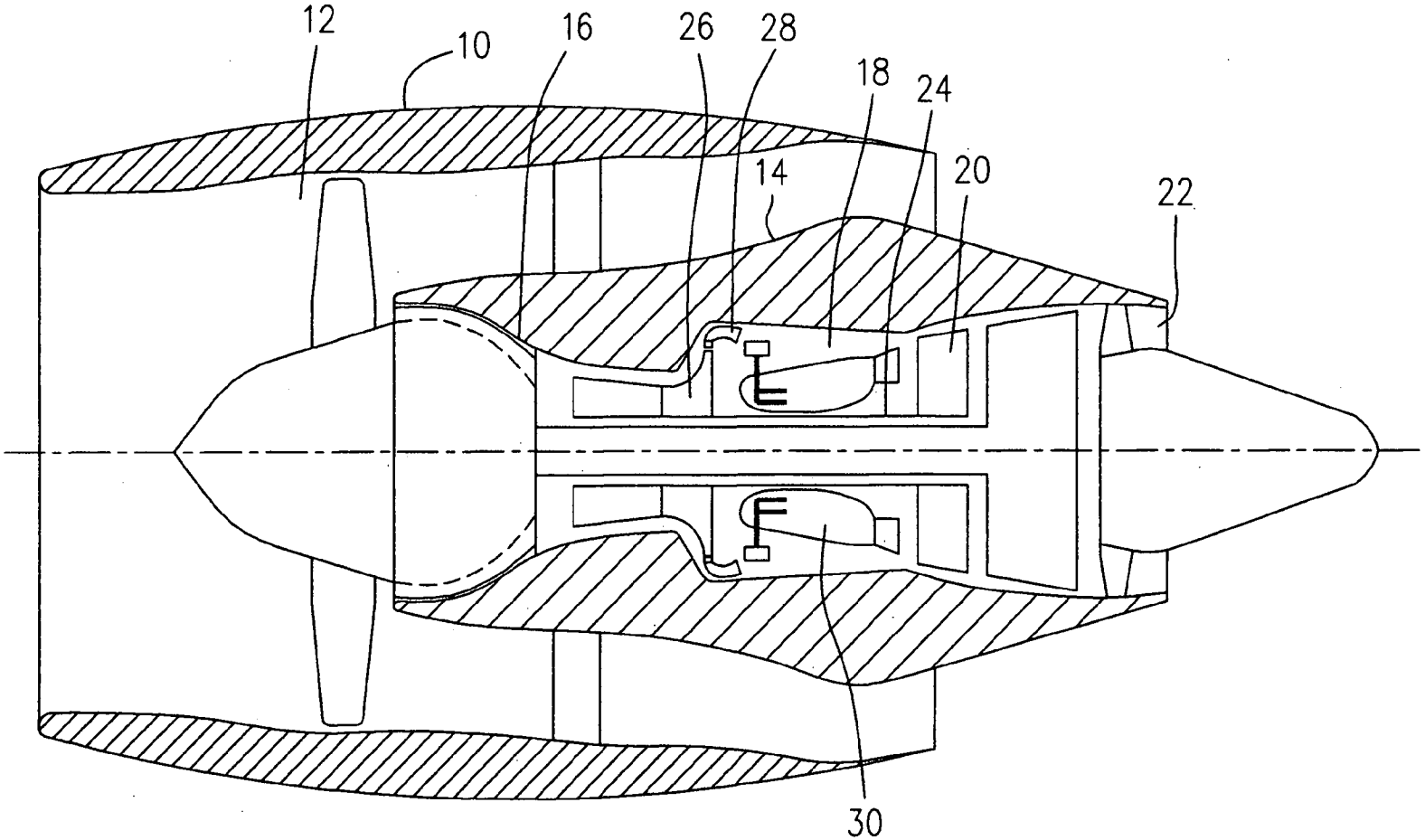
FIG. 1 is a schematic cross-sectional view of a turbofan gas turbine engine showing an exemplary application of the present invention.

Referring to FIG. 1, a turbofan gas turbine engine incorporates an embodiment of the present invention, presented as an example of the application of the present invention, and includes a housing or a nacelle 10 which contains a fan section 12 and at least a major section of a core engine 14. The core engine 14 comprises in flow series, a compressor section 16, a combustion section 18, a turbine section 20, and an exhaust section 22. The turbine section 20 and the compressor section 16 comprise multiple stages. At least one turbine (not indicated) within the turbine section 20 is rotationally connected to the final stage of the compressor section 16 by a shaft 24.

The final stage of the compressor section 16 is a rotating impeller 26 in flow communication with combustion section 18 through a diffuser assembly 28. The impeller 26 draws air axially, and rotation of the impeller 26 increases the velocity of the air flow as the input air is directed over impeller vanes, to flow in a radially outward direction under centrifugal forces. In order to redirect the radial flow of air exiting the impeller 26 to an annular axial flow for presentation to a combustor 30, the diffuser assembly 28 is provided. The diffuser assembly 28 also reduces the velocity and increases the static pressure of the air flow when the air flow is directed therethrough.

Figure 2:
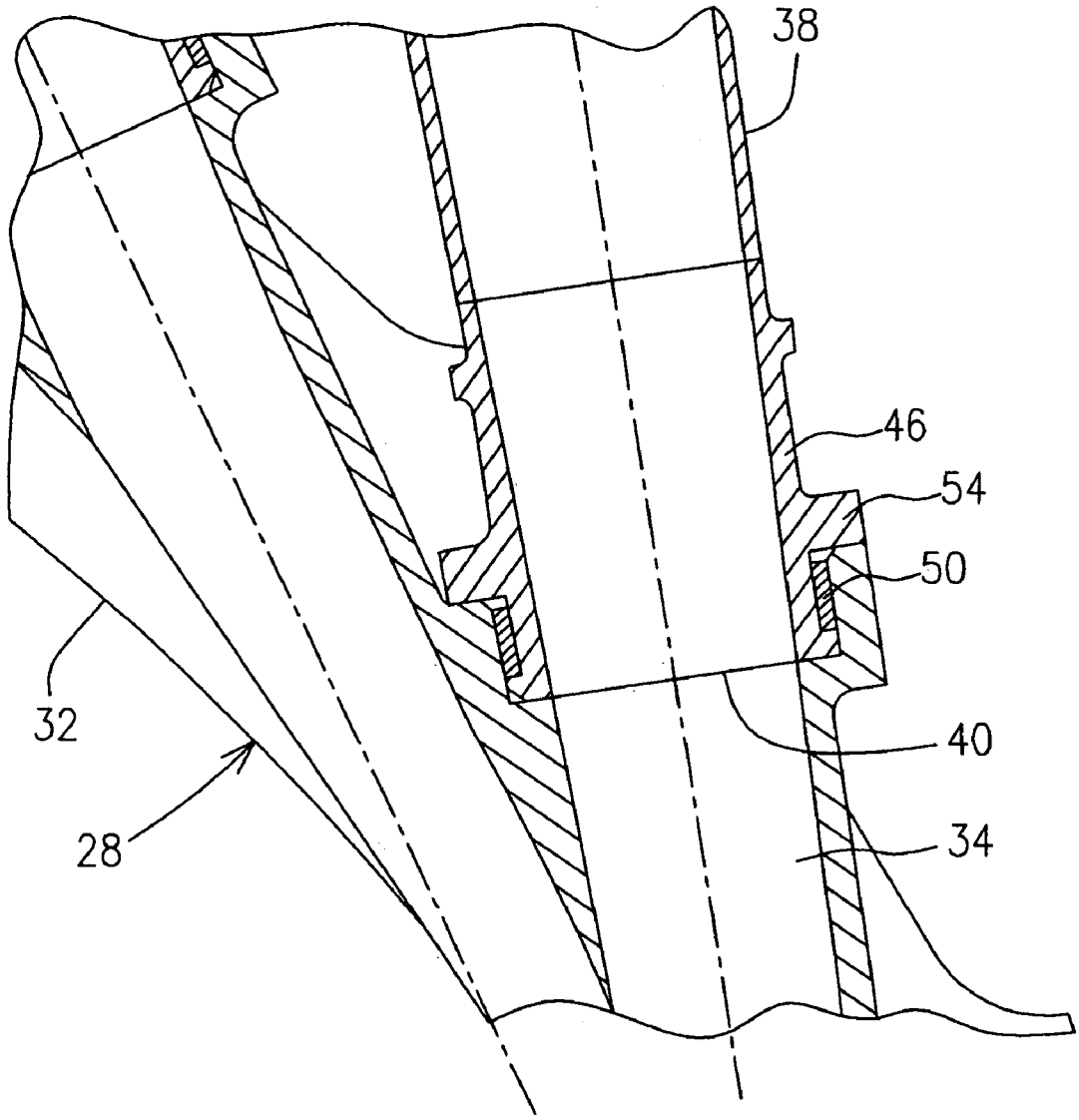
FIG. 2 is a partial cross-sectional view of a compressor diffuser assembly used in the engine of FIG. 1.
Figure 3:
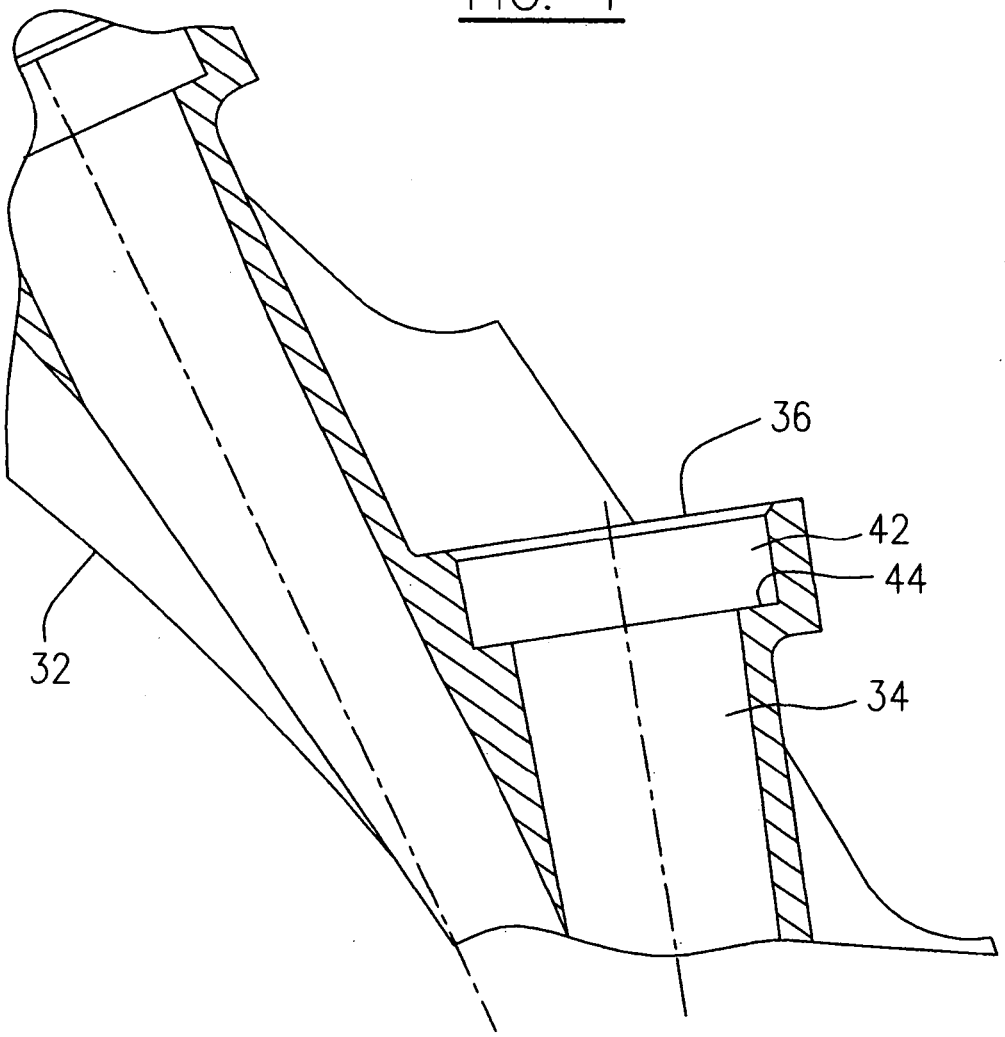
FIG. 3 is a partial cross-sectional view of an annular diffuser body of the compressor diffuser assembly of FIG. 2.

Referring to FIGS. 1–3, the compressor diffuser assembly 28 includes an annular diffuser body 32 which is a machined ring having a plurality of orifices 34 disposed circumferentially spaced apart in an outer periphery 36 thereof, and extending inwardly and tangentially through the annular diffuser body 32. Each of the orifices 34 is intersected by two adjacent orifices 34 in an asymmetrical configuration (only one adjacent orifice is shown). With such a configuration, the annular diffuser body 32 is positioned to surround a periphery of the impeller 26 for capturing the pressure air flow and directing same radially and outwardly through the tangential orifices 34.

Figure 5:
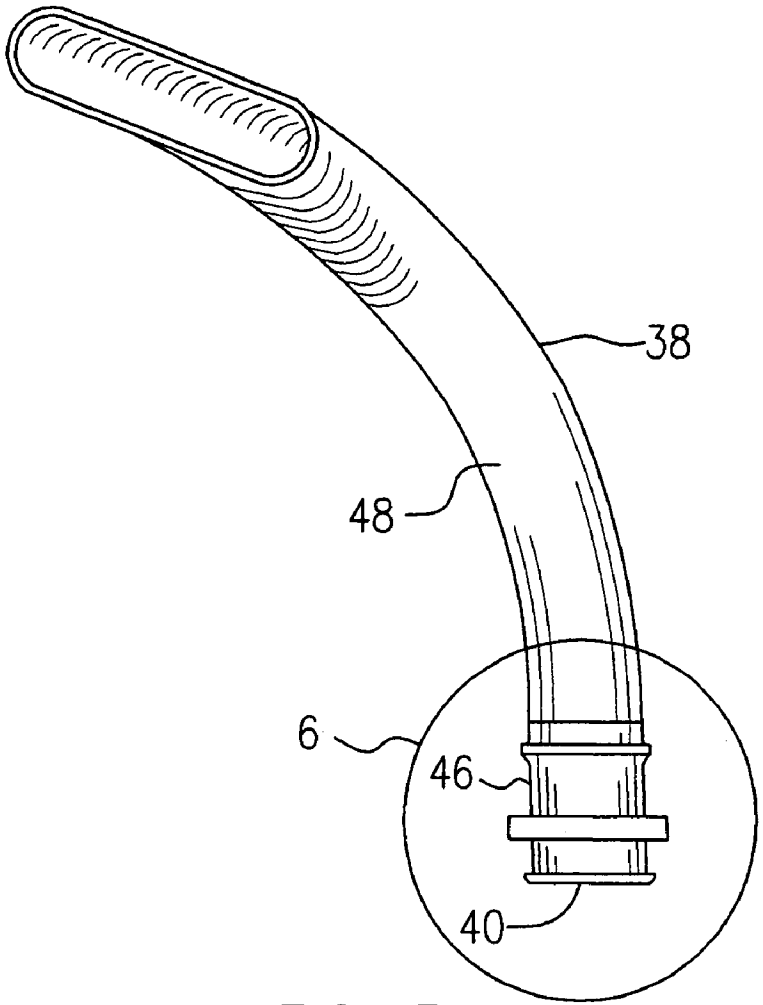
FIG. 5 is a perspective view of a diffuser pipe used in the compressor diffuser assembly of FIG. 2.

The compressor diffuser assembly 28 further includes a plurality of diffuser pipes 38 inserted at one end 40 thereof into the individual orifices 34 of the annular diffuser body 32. Each of the diffuser pipes 38 has a cross-section expanding rearwardly towards a second end thereof, which is generally referred to as "fishtail" pipes (see FIG. 5). The diffuser pips 38 further direct the pressure air flow from the individual tangential orifices 34 through the rearwardly expanding cross-section, thereby discharging the pressure air flow to the combustion section 18 at a low velocity and high pressure.

All orifices 34 and diffuser pipes 38 are identical, respectively, and therefore only one orifice and one diffuser pipe will be described in detail for convenience of the description."

Referring to FIGS. 2–6, the orifice 34 of the annular diffuser body 32 includes a counter-bore 42 which is an enlarged section of the orifice 34 at the orifice entry, thereby forming a substantially right angled step on the interface 44 between the enlarged entry section and the remaining section of the orifice 34.

Figure 6:
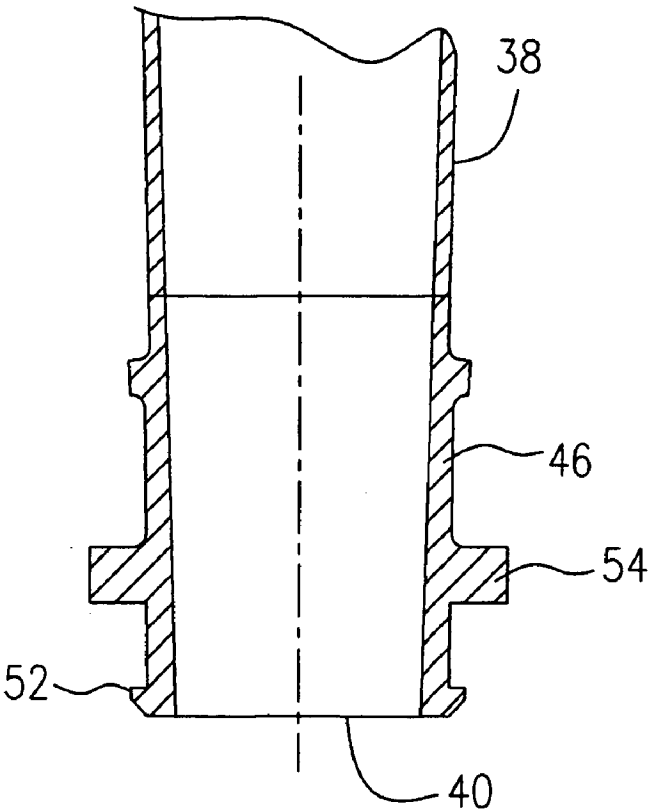
FIG. 6 is an enlarged cross-sectional view of an end portion of the diffuser pipe, as shown in the circled area 6 in FIG. 5.

The diffuser pipe 38 includes an end section 46 defining the end 40 and having a substantially cylindrical profile or a slightly rearwardly expanding round cross-section, as is more clearly shown in FIG. 6.

The remaining section 48 of the diffuser pipe 38 has a curved profile for directing the air flow passing therethrough from a radial direction to a substantially axial direction. The curved remaining section 48 of the diffuser pipe has a cross-section expanding rearwardly towards the distal end thereof (not indicated), but only in one dimension of the cross-section such that the remaining section 48 of the diffuser pipe 38 represents a curved fishtail profile as more clearly shown in FIG. 5. The end section 46 has an outer diameter smaller than the inner diameter of the counter-bore 42, thereby providing an annular space (not indicated) for accommodating a damper member 50 therebetween when the end 40 of the diffuser pipe 38 is inserted into the counter-bore 42.

Figure 4:
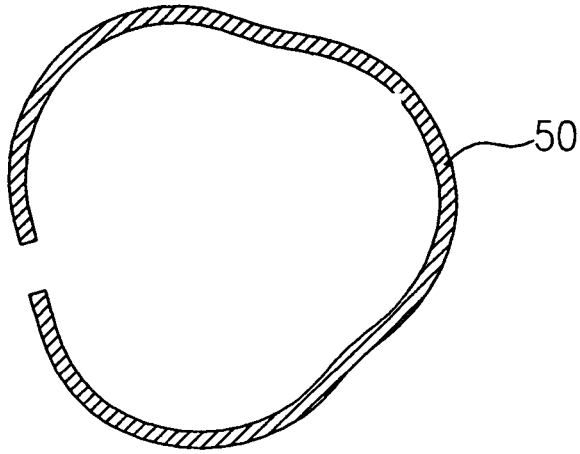
FIG. 4 is a cross-sectional view of a damper member used in the compressor diffuser assembly of FIG. 2.

The damper member 50 in this embodiment of the present invention is a 'marcelled expander', a metal wave spring having an irregular and discontinued ring profile in cross-section, as shown in FIG. 4. The damper member 50 disposed between the end section 46 of the diffuser pipe 38 and the counter-bore 42 of the orifice 34, is forced into a resilient deformation condition which results in frictional forces being applied to the respective outer surface of the end section 46 of the diffuser pipe 38 and the inner surface of the counter-bore 42 of the orifice 34. The frictional forces caused by the damper member 50 thus provides a snug attachment of the diffuser pipe 38 to the orifice 34 of the annular diffuser body 32. Nevertheless, other than a marcelled expander, a damper member of other types can be alternatively used for the present invention, provided that the alternatively used damper members of other types are suitable for working in a relatively high temperature and high pressure of the high pressure compressor air. Examples are waves springs of other types, other spring types and other dampers made of resilient materials, and so on.

The end section 46 of the diffuser pipe 38 preferably includes a rim 52 protruding radially therefrom at the end 40. Preferably, a flange 54 extends radially and outwardly from the end section 46 of the diffuser pipe 38, and is spaced apart from the rim 52 such that the damper member 50 can be retained around the end section 46 between the rim 52 and the flange 54 before the end section 46 of the diffuser pipe 38 is inserted into the counter-bore 42 of the orifice 34.

The rim 52 should have an outer diameter not greater than the inner diameter of the counter-bore 42 of the orifice 34, and the flange 54 preferably has an outer diameter greater than the inner diameter of the counter-bore 42 of the orifice 34. Therefore, the rim 52 is received within the counter-bore 42 of the orifice 34 while the flange 54 is positioned outside of the counter-bore 42 when the end section 46 of the diffuser pipe 38 is inserted into the counter-bore 42 of the orifice 34.

The space between the rim 52 and flange 54 is determined such that the end 40 of the diffuser pipe 38 abuts the interface 44 between the counter-bore 42 and the remaining section of the orifice 34 while the flange 54 abuts the flat surface defining the entry of the counter-bore 42. Alternatively, the depth of the counter-bore 42 should be slightly greater than the distance between the front surface of the flange 54 and the end 40 of the diffuser pipe 38 such that the flange 54 can substantially seal the entry of the counter-bore 42 without interference when the end 40 of the diffuser pipe 38 is inserted into the counter-bore 42 of the orifice 34.

The rim 52 is preferably beveled on the front surface, as shown in FIG. 6 for convenience of receiving the damper member 50 when the damper member 50 is forced to pass thereover in order to be attached to the end section 46 of the diffuser pipe 38 between the rim 52 and the flange 54, prior to insertion of the end 40 of the diffuser pipe 38 into the counter-bore 42 of the orifice 34. For convenience of insertion of the end 40 of the diffuser pipe 38 together with the attached damper member 50, into the counter-bore 42 of the orifice 34, the counter-bore 42 is preferably beveled at the entry thereof.

Although it is preferable to attach the damper member 50 to the end section 46 of the diffuser pipe 38 prior to the insertion of the end 40 of the diffuser pipe 38 into the counter-bore 42 of the orifice 34, the damper member 50 can alternatively be forced into the counter-bore 42 of the orifice 34 prior to the insertion of the end 40 of the diffuser pipe 38 into the counter-bore 42 of the orifice 34.

Because of the employment of damper member 50, the manufacturing tolerances for both the counter-bore 42 in the annular body 32 and the end section 46 are not necessarily limited to a very accurate range, which results in time savings and thus cost savings during manufacture of the diffuser assembly. The damper members 50 provide a tighter or more snug attachment of the diffuser pipes 38 to the annular diffuser body 32 which is damps vibration to acceptable levels to provide good engine reliability.

Modifications and improvements to the above-described embodiment of the present invention may become apparent to those skilled in the art. This invention is not only applicable to turbofan gas turbine engines, but is also applicable to other gas turbine engines in which such a diffuser assembly is equipped. The pipe diffuser need not have the configuration shown, and the present invention may be used with an suitable diffuser configuration. The foregoing description is therefore intended to be exemplary rather than limiting and the scope of the present invention is to be limited solely by the scope of the appended claims.

We claim:

1. A diffuser assembly for a gas turbine engine, the diffuser comprising:

an annular diffuser body having a plurality of orifices disposed circumferentially around an outer periphery thereof, the orifices having an inner wall;

a plurality of diffuser pipes each having a first end thereof received in one of the orifices adjacent the inner wall thereof; and a flexible damper member disposed between the first end and the inner wall of at least one of the orifices.

2. The diffuser assembly as claimed in claim 1 wherein the at least one orifice has an enlarged entry section.

3. The diffuser assembly as claimed in claim 1 wherein said first end ofthe individual diffuser pipes has a damper-retaining rim protruding radially therefrom.

4. The diffuser assembly as claimed in claim 1 wherein the first end includes a flange extending radially therefrom adapted to engage the orifice for limiting insertion thereinto.

5. The diffuser assembly as claimed in claim 1 wherein the damper member is disposed between spaced-apart members extending radially from the diffuser pipe.

6. The diffuser assembly as claimed in claim 3 wherein the rim of the individual diffuser pipes has a beveled front surface.

7. The diffuser assembly as claimed in claim 1 wherein the damper members comprise C-shaped wave springs.

8. A centrifugal compressor system of a gas turbine engine, the compressor system comprising:

an impeller assembly driven by a shaft of the engine for generating a pressurized air flow;

an annular diffuser body having a plurality of orifices disposed circumferentially spaced apart in an outer periphery thereof, the annular diffuser body being downstream of the impeller for directing the pressurized air flow;

a plurality of diffuser pipes inserted at a first end thereof into the orifices of the annular diffuser body, each of the diffuser pipes having a cross section expanding towards a second end thereof; and a damper member disposed between the first end of the diffuser pipes and the orifices, thereby providing a snug attachment of the diffuser pipes to the orifices of the annular diffuser body.

9. The compressor system as claimed in claim 8 wherein the orifices comprise an enlarged entry section thereof for receiving said first end of the diffuser pipes and the damper member therebetween.

10. The compressor system as claimed in claim 9 wherein said first end of the diffuser pipes comprises a rim protruding radially therefrom, the radially protruding rim being received within the enlarged entry section of the orifices.

11. The compressor system as claimed in claim 10 wherein the diffuser pipes comprise a flange extending radially and outwardly therefrom, the flange being disposed outside of the orifices and substantially sealing the enlarged entry section of the orifices.

12. The compressor system as claimed in claim 11 wherein the damper members are disposed between the rim and the flange of the diffuser pipes.

13. The compressor system as claimed in claim 10 wherein the rim of the diffuser pipes comprises a beveled front surface.

14. The compressor system as claimed in claim 8 wherein the damper members comprise a plurality of C-shaped wave springs.

15. A method for assembling a centrifugal compressor diffuser for gas turbine engines, the method comprising:

providing diffuser pipes having a first end diameter;

providing a diffuser body having orifices for receiving the pipes, the orifices having a diameter sufficiently larger than the first end diameter such that a loose fit is provided when the first end is inserted into the orifice;

providing a damper member in at least one of the orifices and said first ends of the diffuser pipes; and inserting the diffuser pipe first ends into the orifices so that the damper member is disposed between the first ends and the orifices to thereby provide a snug attachment therebetween.

16. The method as claimed in claim 15 further comprising sealing between the orifice and the diffuser pipe by abutting a flange affixed to the diffuser pipes against the orifice periphery when the diffuser pipes is inserted into the orifices.

17. The method as claimed in claim 15 further comprising attaching the damper members to said end of the diffuser pipes prior to the assembling step.

18. The method as claimed in claim 15 further comprising the step of retaining the damper members between a first rim and a second rim which are spaced apart and protrude radially from the diffuser pipes.

* * * * *